US007037047B1

(12) United States Patent
Tufts et al.

(10) Patent No.: US 7,037,047 B1
(45) Date of Patent: May 2, 2006

(54) RETAINING WALL BLOCK SYSTEM

(75) Inventors: Paul R. Tufts, Eagan, MN (US); Robert J. Lundell, Stillwater, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 11/001,725

(22) Filed: Dec. 2, 2004

(51) Int. Cl.
*E02D 29/02* (2006.01)
*E04C 2/04* (2006.01)

(52) U.S. Cl. ..... 405/286; 405/284; 52/596; 52/604; 52/608

(58) Field of Classification Search ..... 405/284, 405/286, 262; 52/596, 599, 604, 606, 607–611
See application file for complete search history.

(56) References Cited

U.S. PATENT DOCUMENTS

| | | | | |
|---|---|---|---|---|
| 803,014 | A | 10/1905 | McIlravy | |
| 813,901 | A | 2/1906 | Leming et al. | |
| 819,055 | A | 5/1906 | Fisher | |
| 2,493,547 | A * | 1/1950 | Paolella et al. | 52/605 |
| 2,624,193 | A * | 1/1953 | Larson | 52/606 |
| 3,461,631 | A * | 8/1969 | Brugnola et al. | 52/606 |
| 4,319,440 | A | 3/1982 | Rassias et al. | |
| 4,896,472 | A | 1/1990 | Hunt | |
| 4,920,712 | A | 5/1990 | Dean, Jr. | |
| 5,062,610 | A | 11/1991 | Woolford et al. | |
| 5,214,898 | A | 6/1993 | Beretta | |
| 5,294,216 | A | 3/1994 | Sievert | |

(Continued)

FOREIGN PATENT DOCUMENTS

| | | | | |
|---|---|---|---|---|
| EP | 0 649 714 A1 | | 4/1995 | |
| IT | 709 599 | | 6/1966 | |
| JP | 56000412 | * | 1/1981 | 405/284 |

OTHER PUBLICATIONS

"Contractors—Products—Diamond Pro," http://www.anchorwall.com/asp/Page38.asp, 1 page (Date Printed Aug. 14, 2004).

(Continued)

*Primary Examiner*—Jong-Suk (James) Lee
(74) *Attorney, Agent, or Firm*—Merchant & Gould. P.C.

(57) ABSTRACT

Concrete blocks configured for use in forming retaining walls that require the use of rebar and grout to structurally anchor a retaining wall to a foundation. The blocks include first and second core openings extending through the blocks. The core openings are configured so that when the blocks are stacked into courses with other blocks, the core openings of the blocks line up in a manner that allow rebar to extend through the core openings from the foundation to the top of the retaining wall. Further, the core openings facilitate pouring of the grout down through the aligned core openings. In addition, the core openings are configured so that the core openings do not overhang joints between blocks or overhang block edges that would allow grout to leak out as grout is being poured down the core openings.

30 Claims, 10 Drawing Sheets

U.S. PATENT DOCUMENTS

| | | | | |
|---|---|---|---|---|
| 5,595,460 | A * | 1/1997 | Miller et al. | 405/284 |
| 5,619,835 | A | 4/1997 | Bailey, II et al. | |
| 5,623,797 | A * | 4/1997 | Gravier et al. | 52/604 |
| 5,673,530 | A | 10/1997 | Bailey, II | |
| 5,707,184 | A | 1/1998 | Anderson et al. | |
| 5,984,589 | A | 11/1999 | Ciccarello | |
| 6,079,908 | A | 6/2000 | Anderson | |
| 6,082,057 | A | 7/2000 | Sievert | |
| 6,641,334 | B1 | 11/2003 | Woolford | |

OTHER PUBLICATIONS

"Contractors—Products—Diamond Pro Stone Cut," http://www.anchorwall.com/asp/Page241.asp, 2 pages (Date Printed Aug. 14, 2004).

"EP Henry Hardscaping™ for all Walks of Life," pp. 1-49 (2001).

"Johnson Block Retaining Wall System," 2 pages (Undated).

"Modular Concrete Block," pp. 1-23 (Undated).

* cited by examiner

RETAINING WALL BLOCK SYSTEM

FIELD OF THE INVENTION

The invention relates to concrete blocks for use in forming retaining walls. In particular, the invention relates to concrete blocks configured for use in forming retaining walls that require the use of reinforcing members and a bonding material, for example grout, to structurally anchor a retaining wall to a concrete foundation.

BACKGROUND OF THE INVENTION

Concrete blocks have been a basic building material for many years. Concrete blocks have been designed for use in many applications, including concrete masonry blocks used in the construction of foundations of residential and commercial buildings, as well as in constructing the interior and exterior walls of such buildings, and concrete retaining wall blocks used to construct retaining walls. Concrete masonry blocks are typically laid up in courses with mortar being used to secure the blocks to one another, while concrete retaining wall blocks are typically dry stacked (i.e. no mortar is used) in ascending courses.

One example of a concrete masonry block is the well known gray building block. A common use for these blocks has been in the construction of residential basements, where the gray blocks are laid up with mortar between the blocks to form the walls of such basements. These gray blocks typically have one or more core openings extending vertically therethrough to reduce the amount of concrete used to form each block and to reduce the weight of the block. The core openings also enable the gray blocks to be anchored to an underlying foundation when such anchoring is desired. When the gray blocks are stacked on top of each other into courses to form a wall, the core openings line up with one another. The aligned core openings allow reinforcement, for example rebar, which extends from the foundation, to extend though the core openings and for a bodning material, for example grout, to be poured down into the aligned core openings, for anchoring the wall to the foundation. However, the outside exposed walls formed by such blocks are visually plain and unattractive.

Retaining wall blocks generally have a more attractive front face than gray blocks. One way in which the visual appearance of concrete retaining wall blocks is enhanced is to make the front face less uniform and more "natural" appearing. This can be done by using a splitting process to create an irregular front face, often referred to as a "rock-face", on the block. In this process, as it is commonly practiced, a relatively large concrete workpiece which has been adequately cured is split to form two or more relatively smaller blocks. The resulting blocks have faces that are somewhat textured and irregular along the plane(s) of splitting. Retaining wall blocks are usually dry stacked to form a retaining wall. The blocks may be located with respect to blocks in adjacent courses and held in place by locator lips or protrusions, or by pins.

As with gray building blocks, it is sometimes desirable to anchor a wall that is constructed from retaining wall blocks to a foundation using reinforcement and a bonding material to provide additional stability to the wall. To do so, the retaining wall blocks must be constructed so as to function with the reinforcement and the bonding material.

Accordingly, there is a need for concrete retaining wall blocks that are configured to cooperate with reinforcement and bonding material for anchoring a retaining wall constructed from a plurality of the blocks to a foundation.

SUMMARY OF THE INVENTION

The invention relates to concrete blocks configured for use in forming retaining walls that require the use of reinforcement and a bonding material, for example grout, mortar or concrete, to structurally anchor a retaining wall to a foundation.

The blocks include first and second core openings extending through the blocks from the top surface to the bottom surface. The core openings are configured so that when the blocks are stacked into courses with other blocks, the core openings of the blocks line up in a manner that allow reinforcement members, for example rebar, to extend through the core openings from the foundation to the top of the retaining wall.

Further, the core openings facilitate pouring of the bonding material down through the aligned core openings. In addition, the core openings are configured so that the core openings do not overhang joints between blocks or overhang block edges that would allow bonding material to leak out as the bonding material is being poured down the core openings.

The invention includes a system of concrete blocks for use in forming a retaining wall that includes a plurality of courses of the concrete blocks. One type of block in the system is a concrete corner block for use in constructing an exterior corner of the retaining wall. Another type of block in the system is a concrete wall block for use in construction a wall portion of the retaining wall.

DETAILED DESCRIPTION

Figure 2:
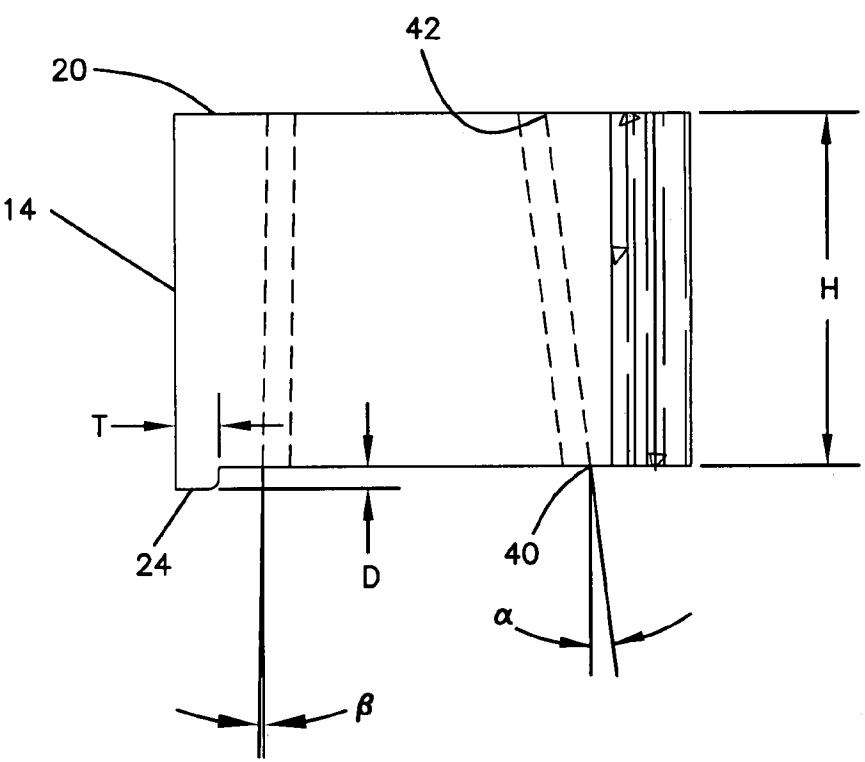
FIG. 2 is a side view of the wall block of FIG. 1.
Figure 1:
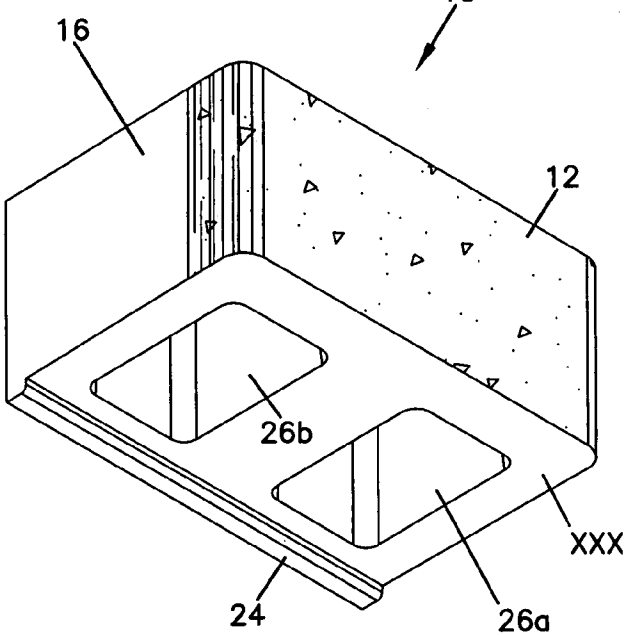
FIG. 1 is a bottom perspective view of a wall block according to the invention.
Figure 3:
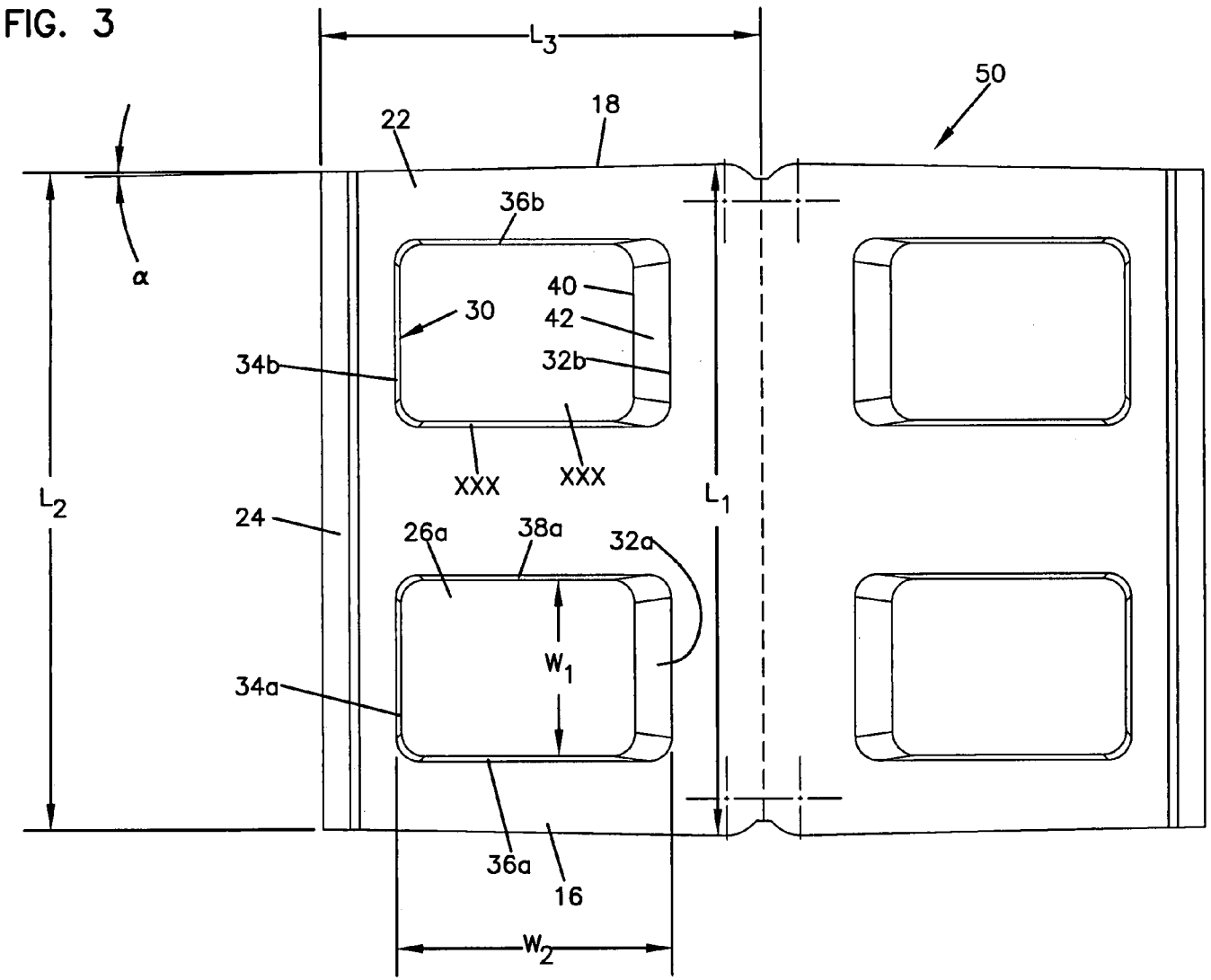
FIG. 3 is a bottom view of two of the wall blocks of FIG. 1, as molded and before being split apart.
Figure 5:
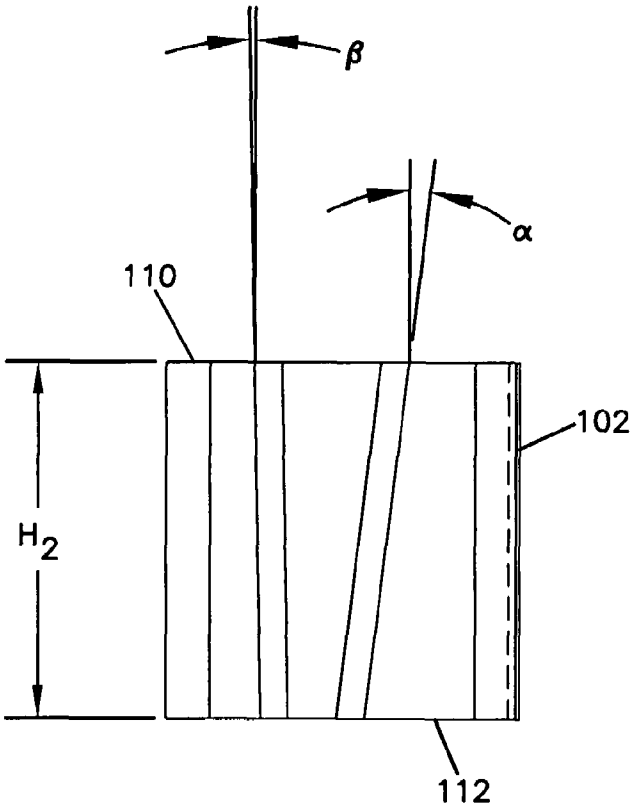
FIG. 5 is a side view of the corner block of FIG. 4.
Figure 4:
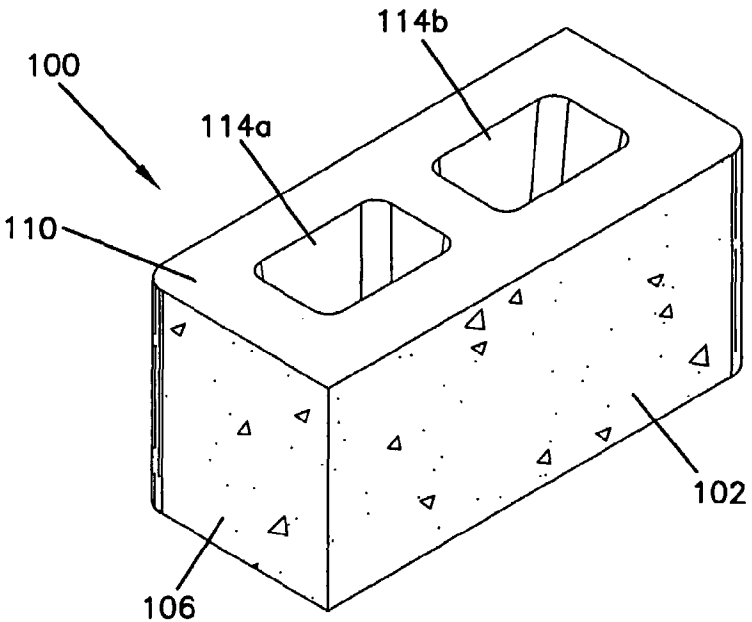
FIG. 4 is a top perspective view of a corner block according to the invention.
Figure 6:
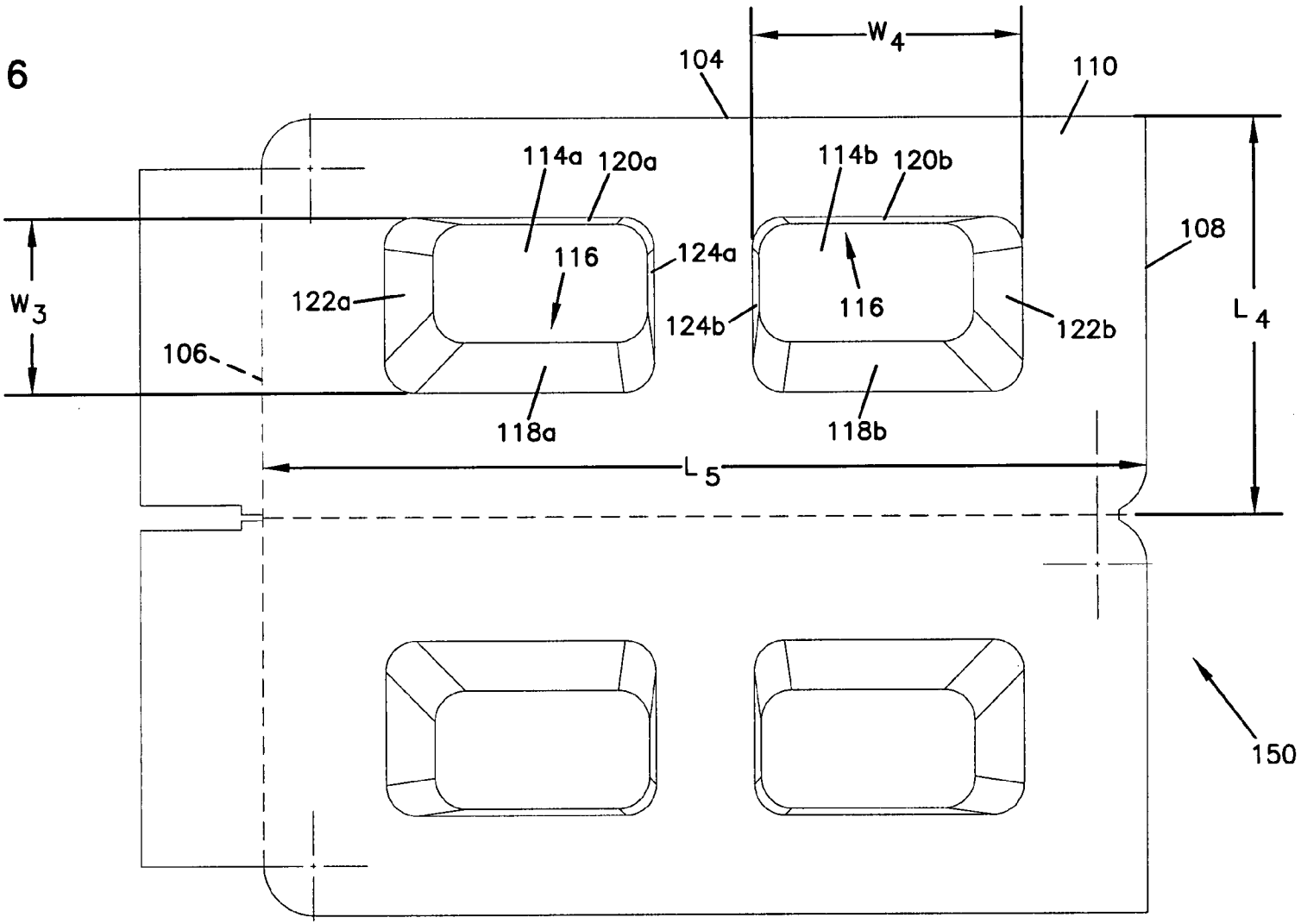
FIG. 6 is a top view of two of the corner blocks of FIG. 4, as molded and before being split apart.

A system of concrete blocks for use in forming a retaining wall according to the invention includes a concrete wall block 10 illustrated in FIGS. 1–3 and a concrete corner block 100 illustrated in FIGS. 4–6.

The blocks 10, 100 are configured to achieve the following criteria when the blocks are laid up in a wall. First, the core openings of the blocks are configured to allow reinforcement, for example rebar, and bonding material, for example grout, to run in a continuous line from the top of the wall to the bottom of the wall where the wall meets the foundation. Second, the core openings are configured so that the core openings that are filled with bonding material do not overhang joints, rear surfaces of blocks, or side surfaces of blocks that would allow the bonding material to leak out as the core openings are being filled. Third, the core openings are configured to facilitate the flow of the bonding material down the core openings during pouring.

The invention will be described hereinafter with respect to the use of rebar as the reinforcement material, and grout as the bonding material. However, it is to be realized that other forms of reinforcement material could be used, for example threaded rod. In addition, other forms of bonding material could be used, including mortar or concrete.

Referring initially to FIGS. 1–3, the wall block 10 comprises a block body having a front surface 12, a rear surface 14, a first side surface 16 and a second side surface 18, a top surface 20, a bottom surface 22, and a locator protrusion 24 integrally formed on either the bottom surface 22 or the top surface 20. In the illustrated embodiment, the locator protrusion is integrally formed on, and projects downwardly from, the bottom surface 22 adjacent the rear surface 14, whereby a rear surface of the locator protrusion 24 forms an extension of the rear surface 14 as illustrated in FIG. 2.

The front surface 12 extends between the side surfaces 16, 18 and is generally planar. However, the front surface 12 could take on other configurations, for example multi-faceted or outwardly curved. In the illustrated block 10, the front surface 12 is generally vertical when the block 10 is laid up in a wall.

The front surface 12 is textured where the degree of texturing of the front surface 12 is greater than the degree of texturing of the top surface 20. In particular, the texturing of the front surface 12 results from a splitting process on a concrete workpiece 50 which has been adequately cured and that is split to form two blocks 10. The resulting front surface 12 is textured and irregular along the plane of splitting, and is often referred to as a "rock-face".

The side surfaces 16, 18 extend from the front surface 12 to the rear surface 14. The side surfaces 16, 18 preferably converge to a small degree toward one another as they extend toward the rear surface 14. In the illustrated embodiment, each side surface 16, 18 tapers at an angle $\alpha$ of about 1.0 degree. A small taper on the side surfaces 16, 18 allows slight adjustments to the blocks making it easier to run a straight line when laying up the wall.

As a result of the taper of the side surfaces 16, 18, the front surface 12 has a length $L_1$ that is greater than a length $L_2$ of the rear surface 14. In addition, the side surfaces 16, 18 have generally equal lengths $L_3$ where the length $L_3$ of the side surfaces 16, 18 is less than the lengths $L_1$ and $L_2$ of the front surface and the rear surface. The block 10 also has a height H between the top and bottom surfaces 20, 22.

The locator protrusion 24 is configured to provide a set back of the block 10 with respect to blocks in a lower course of blocks when the block 10 is stacked on top of other blocks, and to provide course-to-course shear resistance. In the illustrated embodiment, the locator protrusion 24 comprises a flange that projects from the bottom surface 22 and extends from one side surface 16 to the other side surface 18. The flange has a thickness T and projects below the bottom surface 22 a distance D.

First and second core openings 26*a*, 26*b* extend through the block 10 from the top surface 20 to the bottom surface 22. The core openings 26*a*, 26*b* are of identical construction, with the first core opening 26*a* positioned between the first side surface 16 and the second core opening 26*b*, and the second core opening 26*b* positioned between the second side surface 18 and the first core opening 26*a*. Each core opening 26*a*, 26*b* is substantially rectangular in both top and bottom plan views.

Each core opening 26*a*, 26*b* is defined by a side face 30 which diverges from the top surface 20 of the block to the bottom surface 22 of the block so that the area of the core opening at the bottom surface is greater than the area of the core opening at the top surface. In addition, for each core opening 26*a*, 26*b*, a first portion 32*a*, 32*b* of the side face 30 closest to the front surface 12 of the block diverges to a greater degree than other portions of the side face.

In particular, the side face 30 of the core opening 26*a* includes a first front wall 32*a* adjacent the front surface 12, a first rear wall 34*a* adjacent the rear surface 14, a first side wall 36*a* adjacent the first side surface 16, and a second side wall 38*a* adjacent the second core opening 26*b*. The side face of the second core opening 26*b* comprises a plurality of walls including a second front wall 32*b* adjacent the front surface 12, a second rear wall 34*b* adjacent the rear surface 14, a third side wall 36*b* adjacent the second side surface 18 and a fourth side wall 38*b* adjacent the first core opening 26*a*. Further, each core opening at the bottom surface 22 has a bottom forwardmost edge 40 and each core opening at the top surface 20 has a top forwardmost edge 42.

Each of the walls 34*a*, 34*b*, 36*a*, 36*b*, 38*a*, 38*b* diverges at an angle $\beta$, while each wall 32*a*, 32*b* diverges at an angle $\gamma$. The angle $\gamma$, which is greater in value than the angle $\beta$, is chosen so that when the block is stacked atop other like blocks in a lower course of blocks in set-back relation thereto, at least a portion of the bottom forwardmost edge 40 of each core opening is aligned with at least a portion of the top forwardmost edge 42 of core openings of the blocks in the lower course of blocks. This configuration facilitates the flow of grout down core openings when the blocks 10 are stacked into courses, as will be described later with respect to FIGS. 7*a*–7*c*. The angle is selected to facilitate release of core forms which form the core openings 26*a*, 26*b* during molding of the block. During molding of the block, the block is oriented upside down, with the top surface 20 resting on a pallet and the bottom surface 22 and flange 24 facing upward.

The following dimensions for the block 10 can be used.

| | |
|---|---|
| $L_1$ | 18.0 inches |
| $L_2$ | 17.616 inches |
| $L_3$ | 12.0 inches |
| H | 8.0 inches |
| $\alpha$ | 1.0 degree |
| $\beta$ | 1.0 degree |
| $\gamma$ | 7.125 degrees |
| T | 1.0 inch |
| D | 0.5 inch |
| $W_1$ | 5.0 inches |
| $W_2$ | 7.5 inches |

The system also includes the concrete corner block 100 illustrated in FIGS. 4–6. The corner block 100 comprises a block body including a front surface 102, a rear surface 104, a first end surface 106 and a second end surface 108, a generally planar top surface 110, and a generally planar bottom surface 112.

The front surface 102 extends between the end surfaces 106, 108 and is generally planar. In the illustrated block 100, the front surface 102 is generally vertical when the block 100 is laid up in a wall.

The end surfaces 106, 108 extend from the front surface 102 to the rear surface 104 and intersect the front and rear surfaces at generally right angles. The first and second end surfaces 106, 108 have generally equal lengths $L_4$, the front surface 102 and the rear surface 104 have generally equal lengths $L_5$, and the length $L_4$ of the end surfaces is less than the length $L_5$ of the front surface and the rear surface. The block 100 also has a height $H_2$ between the top and bottom surfaces 110, 112.

The front surface 102 and at least one of the end surfaces, for example end surface 106, are textured where the degree of texturing of the front surface 102 and the end surface 106 is greater than the degree of texturing of the top surface 110. The texturing of the front surface 102 and end surface 106 results from a splitting process on a concrete workpiece 150, shown in FIG. 6, which has been adequately cured and that is split to form two corner blocks 100. The resulting front surface 102 and end surface 106 are textured and irregular along the plane of splitting, and the surfaces 102, 106 are often referred to as "rock-faces".

First and second core openings 114*a*, 114*b* extend through the block 100 from the top surface 110 to the bottom surface 112. The core openings 114*a*, 114*b* are mirror images of each other, with the first core opening 114*a* positioned between the first end surface 106 and the second core opening 114*b*, and the second core opening 114*b* positioned between the second end surface 108 and the first core opening 114*a*. Each core opening 114*a*, 114*b* is substantially rectangular in both top and bottom plan views.

Each core opening 114*a*, 114*b* is defined by a side face 116 which converges from the top surface 110 of the block 100 to the bottom surface 112 of the block so that the area of the core opening at the top surface is greater than the area of the core opening at the bottom surface. In addition, for each core opening 114*a*, 1114*b*, a first portion 118*a*, 118*b* of the side face 116 closest to the front surface 102 and a second portion 122*a*, 122*b* of the side face 116 closest to the adjacent end surface 106, 108 of the block 100 converges to a greater degree than other portions of the side face.

In particular, the side face 116 of the core opening 114*a* includes a first front wall 118*a* adjacent the front surface 102, a first rear wall 120*a* adjacent the rear surface 104, a first side wall 122*a* adjacent the first end surface 106, and a second side wall 124*a* adjacent the second core opening 114*b*. The side face of the second core opening 114*b* comprises a plurality of walls including a second front wall 118*b* adjacent the front surface 102, a second rear wall 120*b* adjacent the rear surface 104, a third side wall 122*b* adjacent the second end surface 108 and a fourth side wall 124*b* adjacent the first core opening 114*a*.

Each of the walls 120*a*, 120*b*, 124*a*, 124*b* diverges at the angle β, while each wall 118*a*, 118*b*, 122*a*, 122*b* diverges at the angle γ. As with the wall block 10, the angle γ is greater in value than the angle β.

As with the block 10, the angle β of each core opening 114*a*, 114*b* is selected to facilitate release of core forms which form the core openings 114*a*, 114*b* during molding of the block 100. During molding of the block 100, the block is oriented as shown in FIG. 5 with the bottom surface 112 resting on a pallet and the top surface 110 facing upward.

The following dimensions for the corner block 100 can be used.

| | |
|---|---|
| $L_4$ | 8.0 inches |
| $L_5$ | 18.0 inches |
| $H_2$ | 8.0 inches |
| β | 1.0 degree |

-continued

| | |
|---|---|
| γ | 7.125 degrees |
| $W_3$ | 3.5 inches |
| $W_4$ | 5.5 inches |

Turning now to FIGS. 7–10, the construction of a wall 200 using the blocks 10, 100 will now be described. During construction of the wall 200, some of the blocks 10, 100 need to be cut near a corner 202 of the wall due to the configuration of the blocks. In addition to the corner 202, the wall 200 also includes a set-back wall section 204 in which each course is set-back from the blocks in the adjacent lower course and a vertical wall section 206 in which the wall is generally vertical and there is no course-to-course set-back. The section 206 is formed using the blocks 10, but with the flanges 24 removed by knocking the flanges off, for example using a hammer and a chisel. The blocks in section 206 will be referenced as blocks 10', with all other features of the blocks 10' being referenced using the same reference numerals as for block 10.

The depth $L_4$ of the block 100 is chosen to account for the fact that the wall section 206 is vertical with no set-back. In particular, the depth $L_4$ of the block 100 is equal to $0.5\times L_1-T$.

Figure 7A:
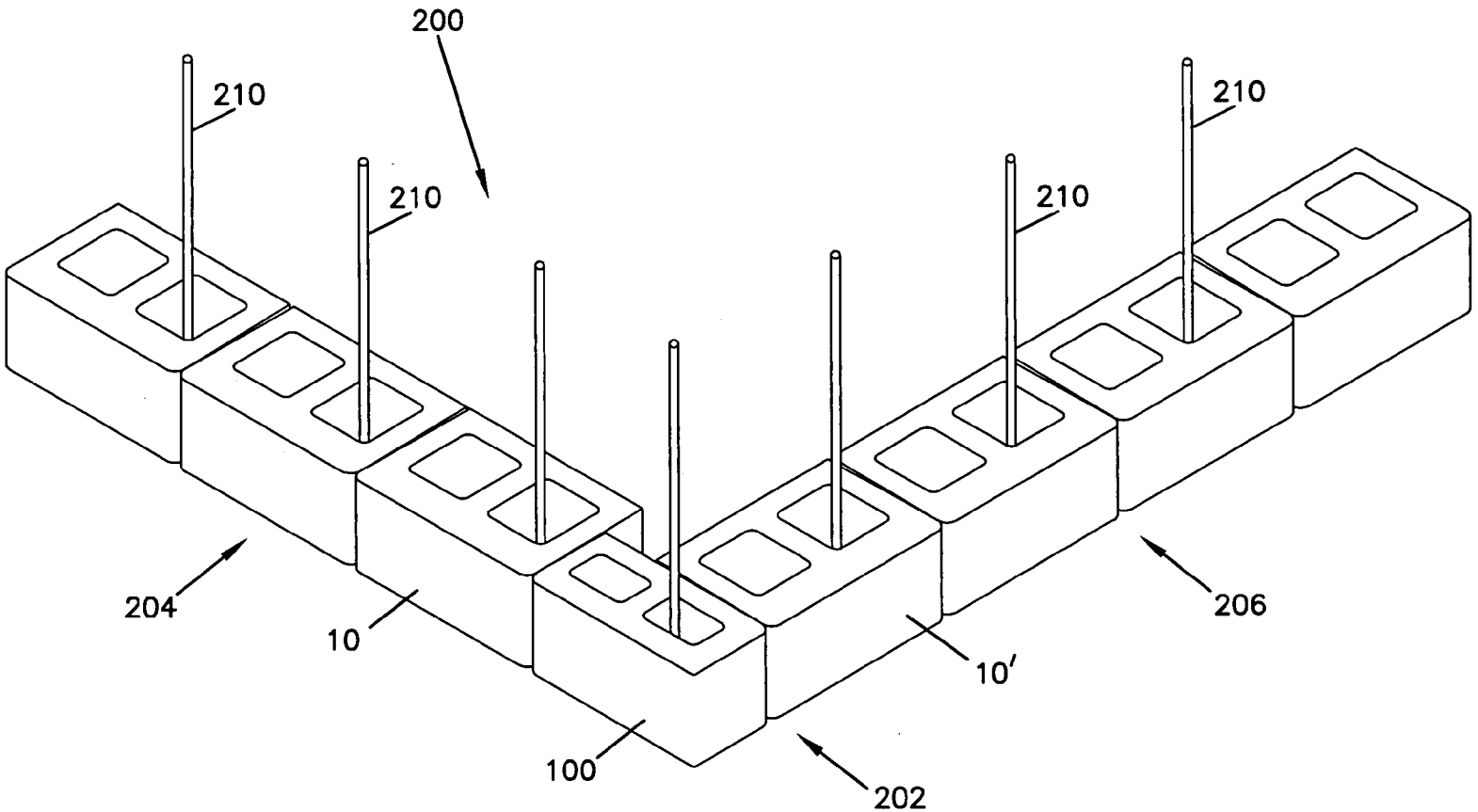
FIGS. 7*a*, 7*b* and 7*c* illustrate first, second and third courses of a portion of a retaining wall constructed from a plurality of the blocks according to the invention.

FIG. 7*a* shows a portion of a first course of the wall 200. Prior to laying the first course, a suitable foundation (not shown) is prepared from which extends rebar 210. The foundation will be described herein as a concrete foundation and the rebar is preferably anchored in the concrete foundation.

The first course is laid as shown in FIG. 7*a*, with the rebar 210 extending through approximately the centers of the core openings 26*a*, 114*a*. A portion, for example 1.0 inch, of the end of the corner block 100 adjacent the block 10 is preferably cut off thereby reducing the length of the block 100. This minimizes cutting in upper courses. In some walls, reinforcement of the corner 202 is not necessary, in which case the corner blocks 100 need not be formed with core openings.

Figure 7B:
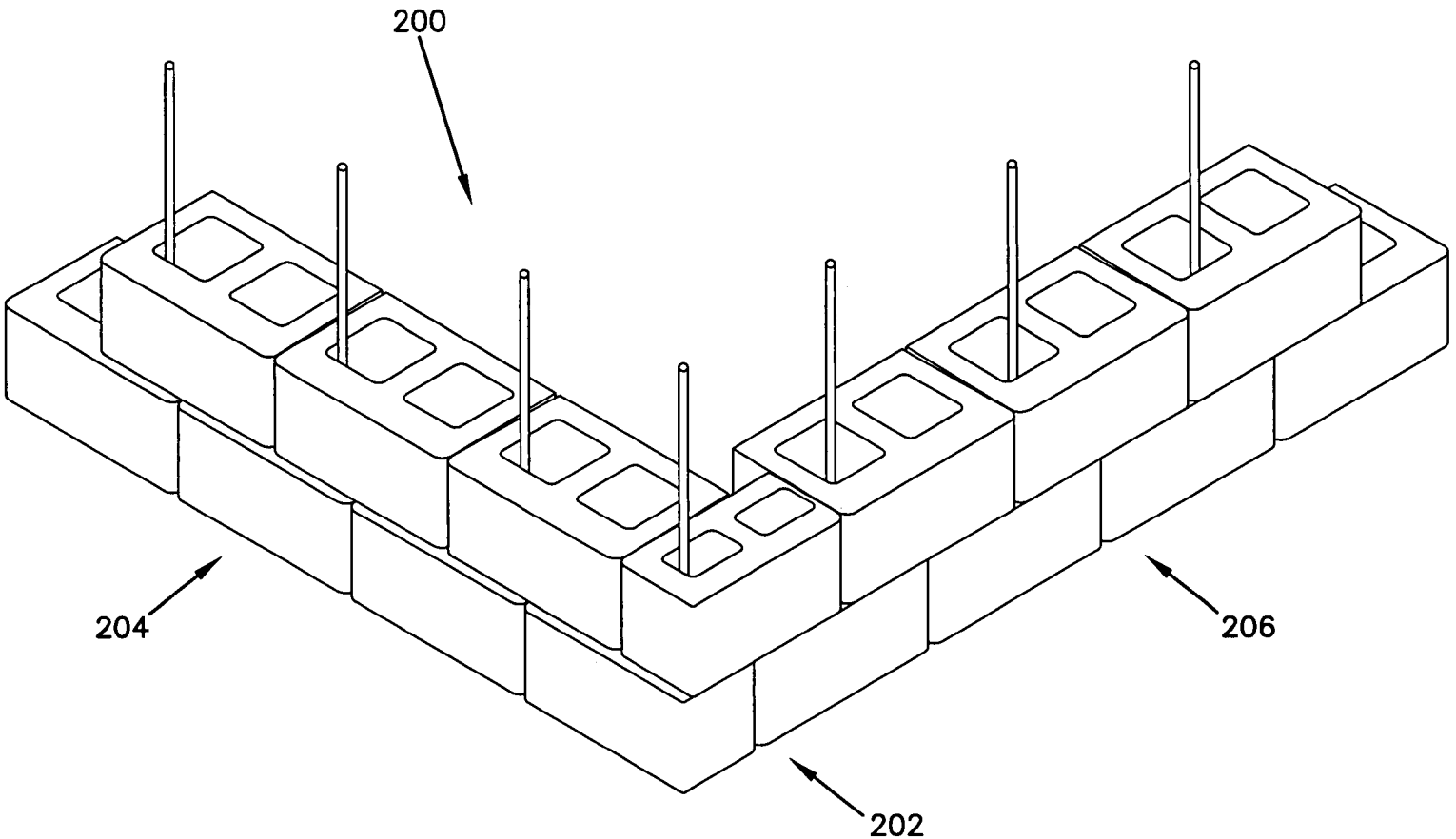
Figure 7C:
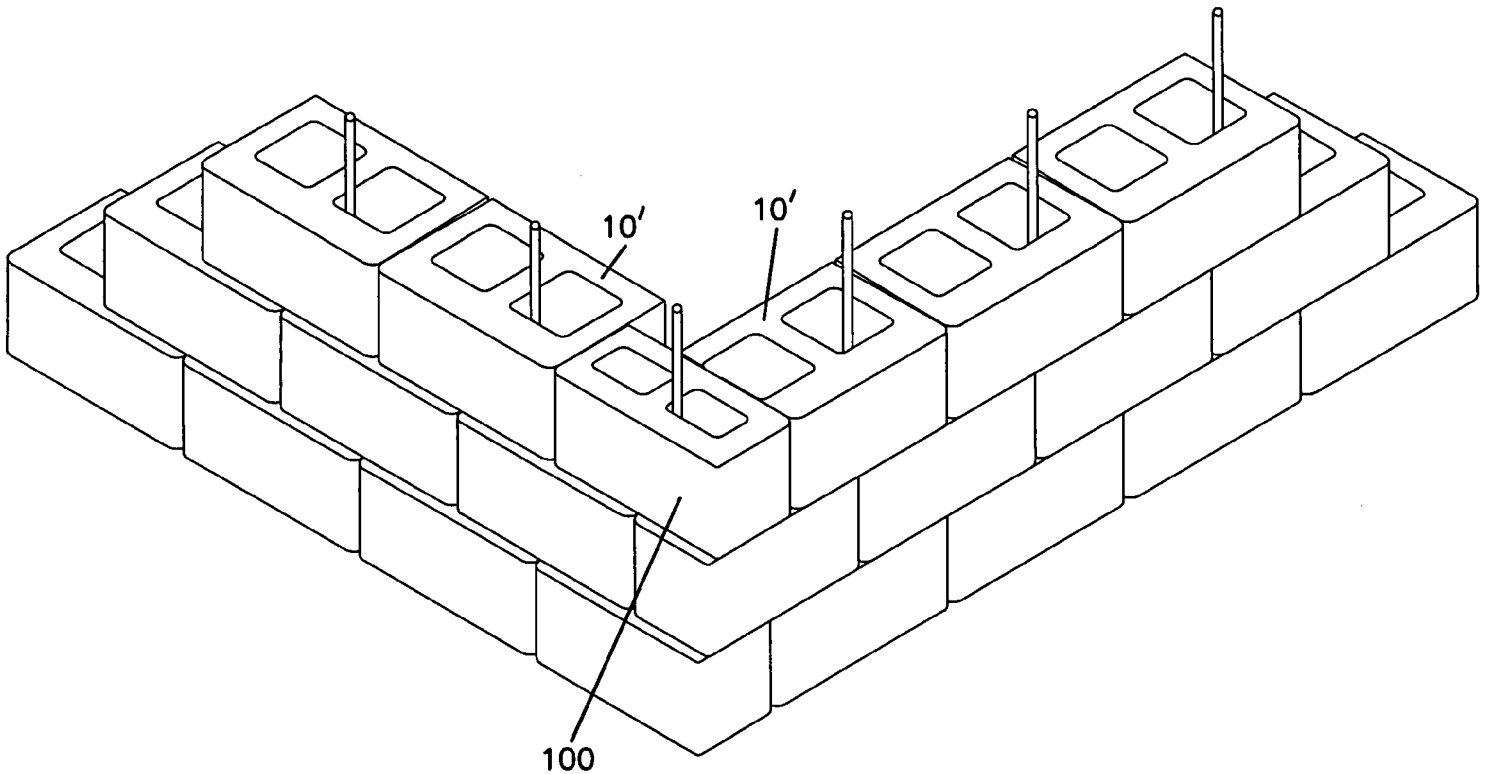

FIG. 7*b* shows the second course laid on the first course. The blocks 10, 10' are laid so as to overlap two blocks in the first course, but with the block 10 adjacent the corner 202 overlapping a block 10 and the corner block 100 in the first course. The corner block 100 is again cut, this time a portion adjacent the wall section 206. In FIG. 7*c*, the third course is laid on the second course as shown. In the third course, a portion of the block 10' adjacent the corner block 100 and the end of the corner block 100 adjacent the block 10 are cut.

Figure 8:
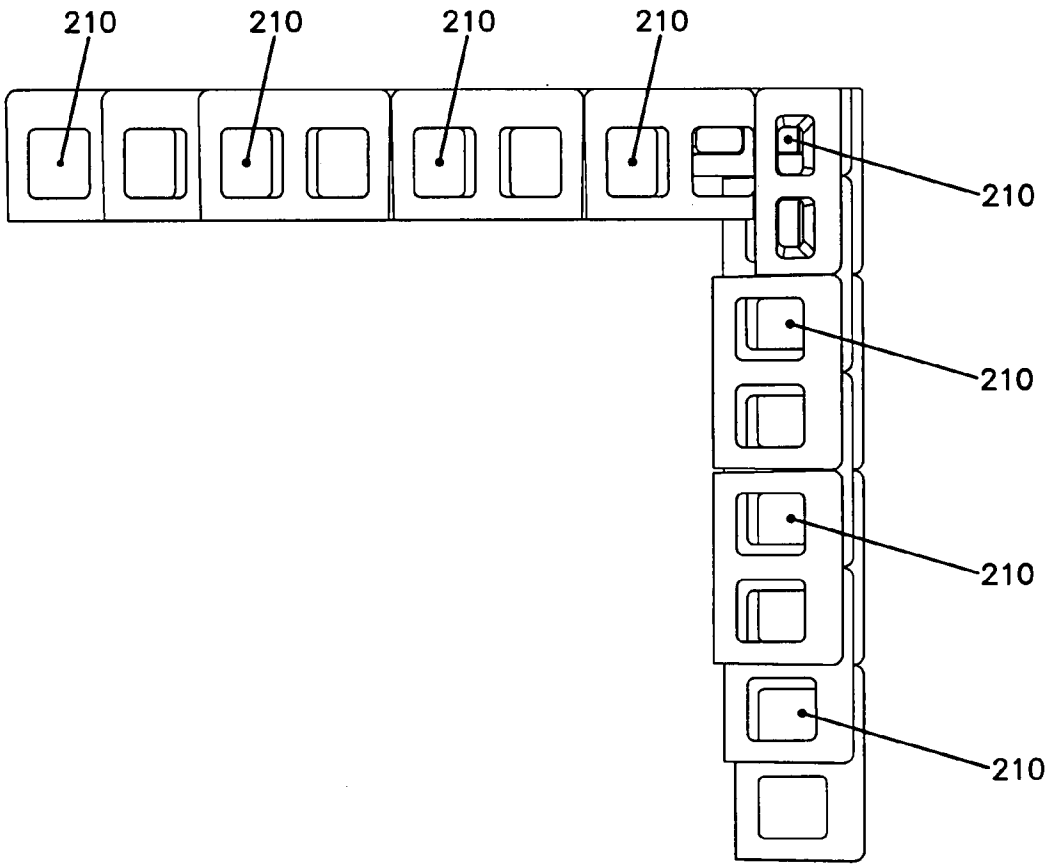
FIG. 8 is a top view of the wall portion in FIG. 7*c*.

FIG. 8 is a top view of the wall shown in FIG. 7, showing how the rebar 210 extends through the aligned core openings of the blocks. FIG. 8 also shows how the core openings in the courses are aligned, thereby allowing grout to be poured down the aligned openings around the rebar.

Figure 9:
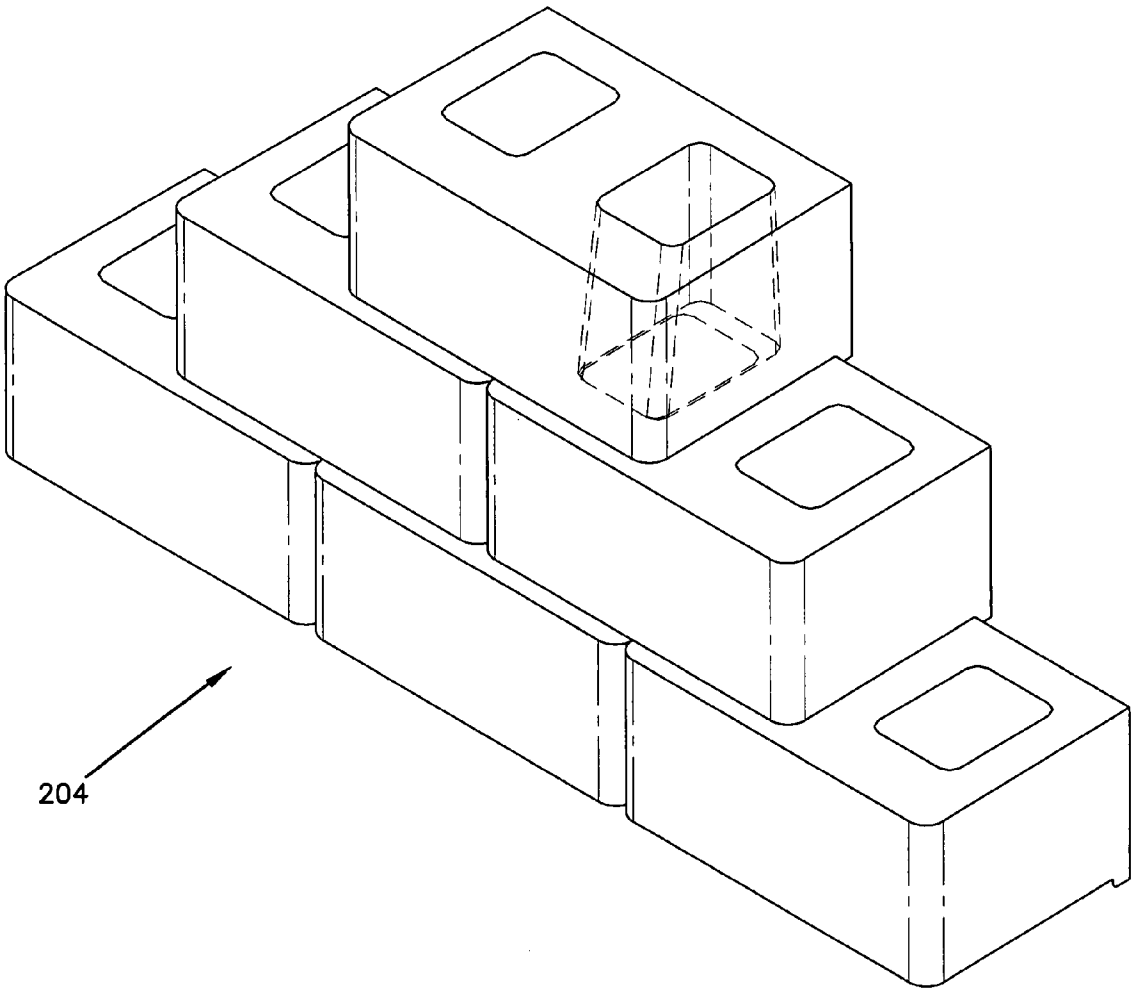
FIG. 9 is a perspective view of a portion of the wall illustrating alignment of the core openings of the wall blocks.

FIG. 9 illustrates a portion of the wall section 204 showing how at least a portion of the bottom forwardmost edge 40 of each core opening 26*a*, 26*b* is aligned with at least a portion of the top forwardmost edge 42 of the core openings 26*a*, 26*b* of the blocks 10 in the lower course of blocks. This alignment allows the grout to flow more easily down through the core openings while pouring grout into the core openings from above.

Figure 10:
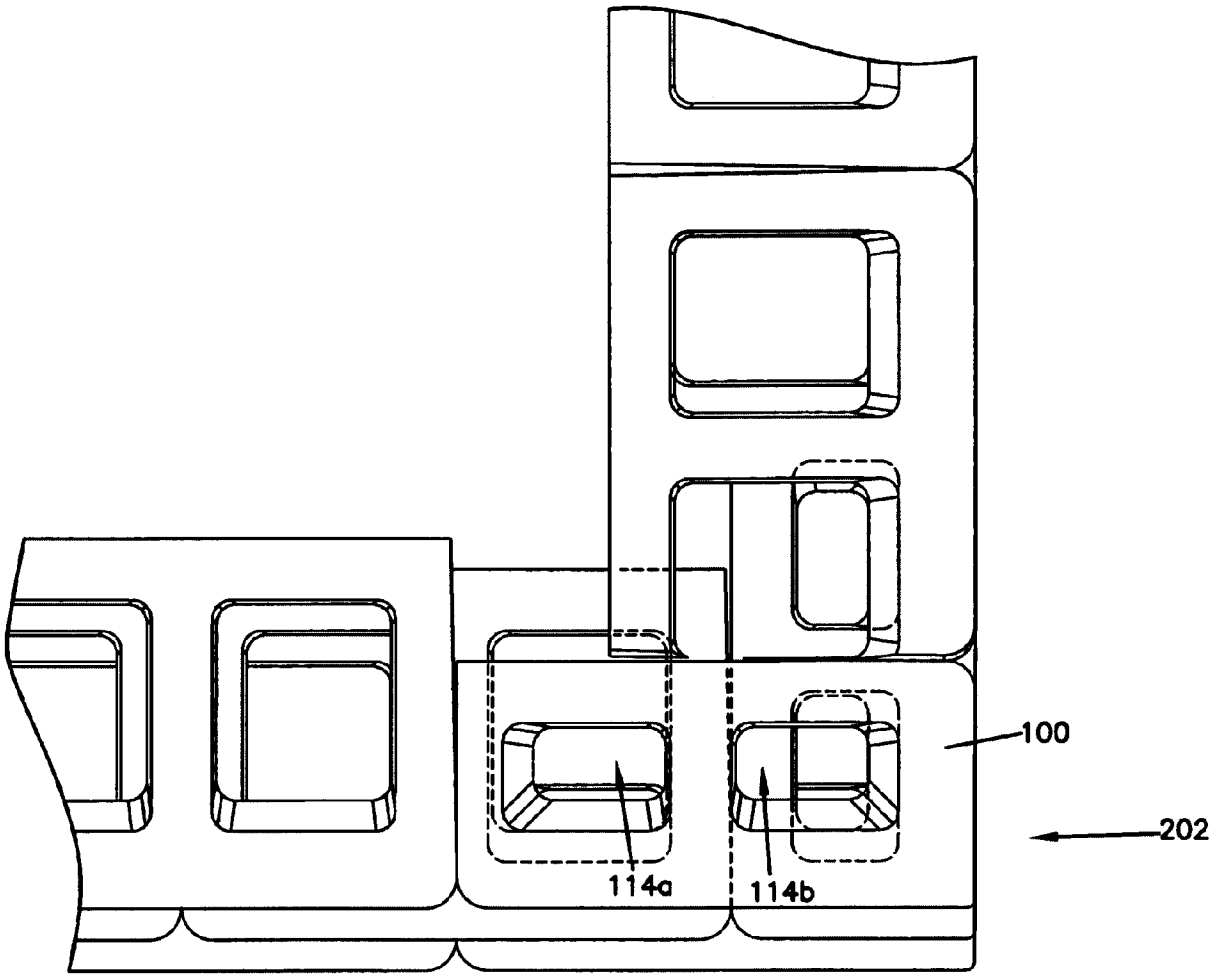
FIG. 10 is a top view of the corner of the wall illustrating alignment of the core openings of the corner blocks.
Figure 2:
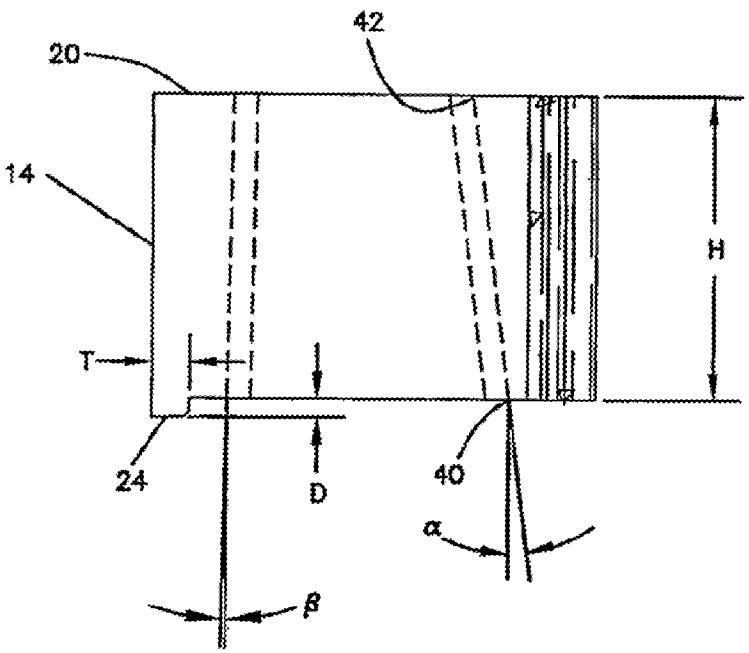
Figure 1:
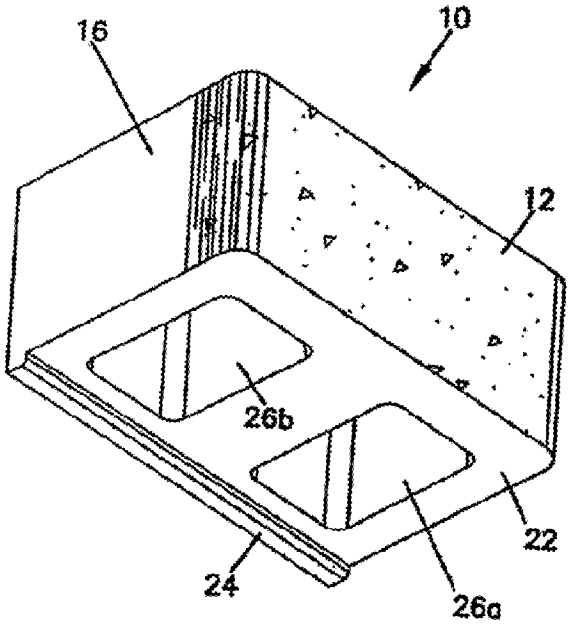
Figure 3:
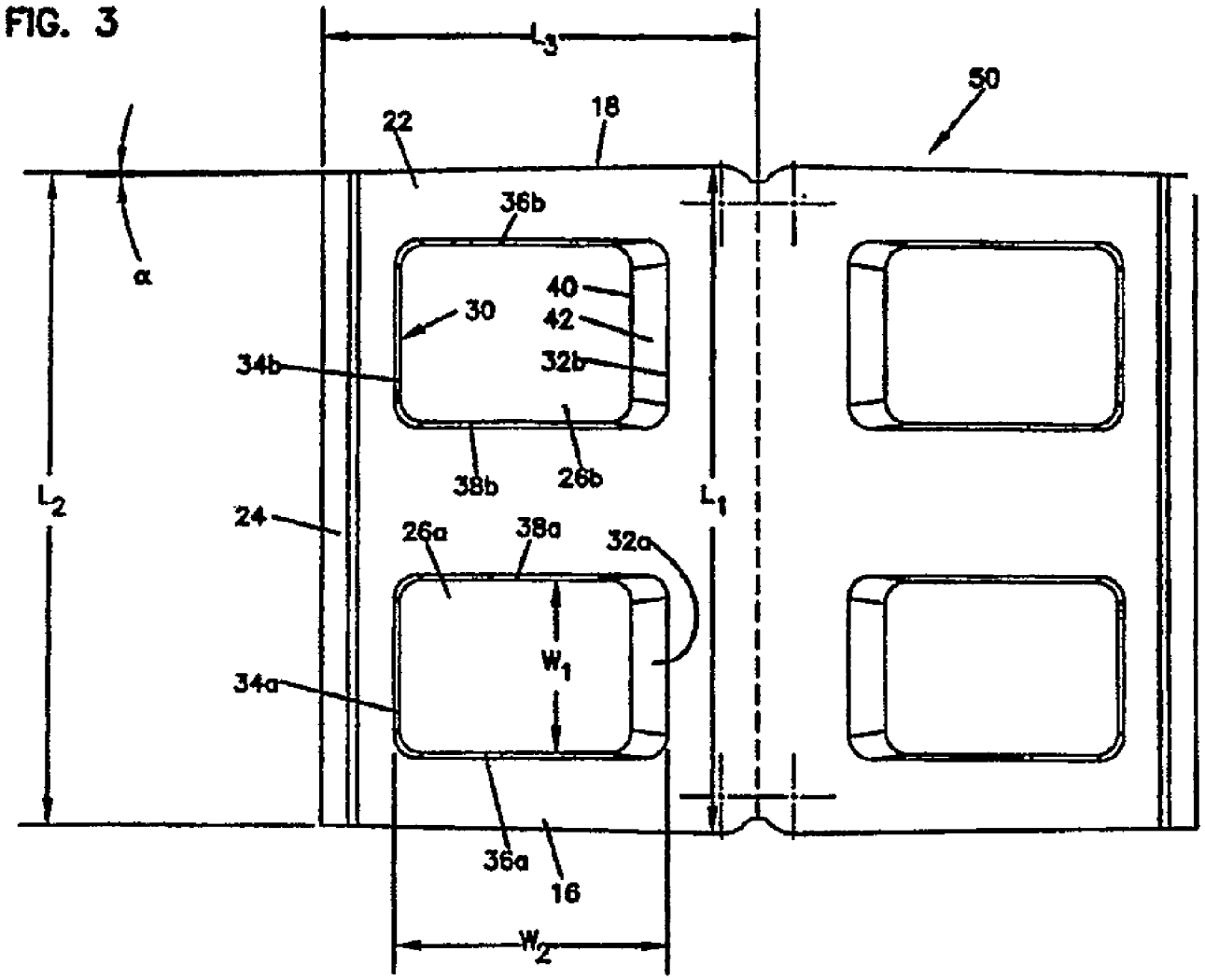

Similarly, FIG. 10 illustrates a top view of the corner 202 in detail. Because the core openings 114*a*, 114*b* converge from the top of the corner block 100 to the bottom, the core openings 114*a*, 114*b* form a funnel which allows the grout to flow more easily down through the core openings while pouring grout into the core openings from above.

Once the courses are in place, grout is then poured down the core openings containing the rebar 210. As discussed above, the core openings of the blocks 10, 100 are configured so that the core openings that are to be filled with grout do not overhang joints, rear surfaces of blocks, or side surfaces of blocks that would allow the grout to leak out as the core openings are being filled with grout. In addition, the configuration of the core openings of the blocks 10, 100 facilitates the flow of grout downward through the aligned core openings. Once the grout is set, the wall is structurally anchored to the foundation on which the wall is constructed.

What is claimed is:

1. A concrete corner block for use in constructing an exterior corner of a retaining wall, the concrete corner block comprising:

a front surface, a rear surface, first and second end surfaces extending from the front surface to the rear surface and intersecting the front and rear surfaces at generally right angles, a generally planar top surface, and a generally planar bottom surface;

the first and second end surfaces having generally equal lengths, the front surface and the rear surface having generally equal lengths, the length of the end surfaces being less than the length of the front surface and the rear surface, and the front surface and at least one of the end surfaces having textures wherein the degree of texturing of the front surface and the one end surface is greater than the degree of texturing of the top surface;

first and second core openings extending through the block from the top surface to the bottom surface, the first core opening being positioned between the first end surface and the second core opening and the second core opening being positioned between the second end surface and the first core opening; and each core opening being defined by a side face which converges from the top surface of the block to the bottom surface of the block so that the area of the core opening at the top surface is greater than the area of the core opening at the bottom surface; and for each core opening, a first portion of the side face closest to the front surface and a second portion of the side face closest to the adjacent end surface of the block converges to a greater degree than other portions of the side face.

2. The concrete corner block of claim 1, wherein the side face of the first core opening comprises a plurality of walls including a first front wall adjacent the front surface, a first rear wall adjacent the rear surface, a first side wall adjacent the first end surface, and a second side wall adjacent the second core opening, and the side face of the second core opening comprises a plurality of walls including a second front wall adjacent the front surface, a second rear wall adjacent the rear surface, a third side wall adjacent the second end surface and a fourth side wall adjacent the first core opening.

3. The concrete corner block of claim 2, wherein the first portion of the side faces includes the first and second front walls.

4. The concrete corner block of claim 3, wherein the second portion of the side faces includes the first side wall of the first core opening and the third side wall of the second core opening.

5. The concrete corner block of claim 1, wherein each core opening is substantially rectangular in top plan view.

6. A concrete retaining wall block, comprising:

a front surface, a rear surface, first and second side surfaces extending from the front surface to the rear surface, a top surface, a bottom surface, and a locator protrusion integrally formed on either the bottom surface or the top surface;

the side surfaces having generally equal lengths, the front surface having a length greater than the length of the rear surface, the length of the side surfaces being less than the length of the front surface and the rear surface, and the front surface having a texture wherein the degree of texturing of the front surface is greater than the degree of texturing of the top surface; and first and second core openings extending through the block from the top surface to the bottom surface, the first core opening being positioned between the first side surface and the second core opening and the second core opening being positioned between the second side surface and the first core opening;

each core opening is defined by a side face which diverges from the top surface of the block to the bottom surface of the block so that the area of the core opening at the bottom surface is greater than the area of the core opening at the top surface; and for each core opening, a first portion of the side face closest to the front surface of the block diverges to a greater degree than other portions of the side face.

7. The concrete retaining wall block of claim 6, wherein the side face of the first core opening comprises a plurality of walls including a first front wall adjacent the front surface, a first rear wall adjacent the rear surface, a first side wall adjacent the first side surface, and a second side wall adjacent the second core opening, and the side face of the second core opening comprises a plurality of walls including a second front wall adjacent the front surface, a second rear wall adjacent the rear surface, a third side wall adjacent the second side surface and a fourth side wall adjacent the first core opening.

8. The concrete retaining wall block of claim 7, wherein the first portion of the side faces comprises the first and second front walls.

9. The concrete retaining wall block of claim 6, wherein each core opening is substantially rectangular in top plan view.

10. The concrete retaining wall block of claim 6, wherein the locator protrusion comprises a flange formed on the bottom surface and projecting downward therefrom.

11. The concrete retaining wall block of claim 6, wherein the first and second side surfaces intersect the rear surface at an angle of about 1 degree.

12. A concrete retaining wall block for stacking into courses with other like blocks to form a retaining wall, comprising:

a front surface, a rear surface, first and second side surfaces extending from the front surface to the rear surface, a top surface, a bottom surface, and a locator protrusion integrally formed on the bottom surface;

the side surfaces having generally equal lengths, the front surface having a length greater than the length of the rear surface, the length of the side surfaces being less than the length of the front surface and the rear surface, and the front surface having a texture wherein the degree of texturing of the front surface is greater than the degree of texturing of the top surface; and first and second core openings that extend through the block from the top surface to the bottom surface, the first core opening being positioned between the first side surface and the second core opening and the second core opening being positioned between the second side surface and the first core opening;

each core opening being configured so that the area of the core opening at the bottom surface is greater than the area of the core opening at the top surface, and the core opening at the bottom surface has a bottom forwardmost edge and the core opening at the top surface has a top forwardmost edge; and the core openings being configured so that when the block is stacked atop other like blocks in a lower course of blocks in set-back relation thereto, at least a portion of the bottom forwardmost edge of each core opening is aligned with at least a portion of the top forwardmost edge of core openings of the blocks in the lower course of blocks.

13. The concrete retaining wall block of claim 12, wherein each core opening is defined by a side face which diverges from the top surface of the block to the bottom surface of the block, and for each core opening, a first portion of the side face extending from the top forwardmost edge to the bottom forwardmost edge diverges to a greater degree than other portions of the side face.

14. The concrete retaining wall block of claim 13, wherein the side face of the first core opening comprises a plurality of walls including a first front wall adjacent the front surface, a first rear wall adjacent the rear surface, a first side wall adjacent the first end surface, and a second side wall adjacent the second core opening, and the side face of the second core opening comprises a plurality of walls including a second front wall adjacent the front surface, a second rear wall adjacent the rear surface, a third side wall adjacent the second end surface and a fourth side wall adjacent the first core opening.

15. The concrete retaining wall block of claim 14, wherein the first portion of the side faces comprises the first and second front walls.

16. The concrete retaining wall block of claim 12, wherein each core opening is substantially rectangular in top plan view.

17. The concrete retaining wall block of claim 12, wherein the locator protrusion comprises a flange projecting downward from the bottom surface.

18. The concrete retaining wall block of claim 12, wherein the first and second side surfaces intersect the rear surface at an angle of about 1 degree.

19. A system of concrete blocks for use in forming a retaining wall that includes a plurality of courses of the concrete blocks, comprising:

a) a concrete corner block having:

i) a front surface, a rear surface, first and second end surfaces extending from the front surface to the rear surface and intersecting the front and rear surfaces at generally right angles, a generally planar top surface, and a generally planar bottom surface;

ii) the first and second end surfaces having generally equal lengths, the front surface and the rear surface having generally equal lengths, the length of the end surfaces being less than the length of the front surface and the rear surface, and the front surface and at least one of the end surfaces having textures wherein the degree of texturing of the front surface and the one end surface is greater than the degree of texturing of the top surface;

iii) first and second core openings extending through the block from the top surface to the bottom surface, the first core opening being positioned between the first end surface and the second core opening and the second core opening being positioned between the second end surface and the first core opening; and iv) each core opening being defined by a side face which converges from the top surface of the block to the bottom surface of the block so that the area of the core opening at the top surface is greater than the area of the core opening at the bottom surface; and v) for each core opening, a first portion of the side face closest to the front surface and a second portion of the side face closest to the adjacent end surface of the block converges to a greater degree than other portions of the side face;

b) a concrete wall block having:

i) a front surface, a rear surface, first and second side surfaces extending from the front surface to the rear surface, a top surface, a bottom surface, and a locator protrusion integrally formed on the bottom surface;

ii) the side surfaces having generally equal lengths, the front surface having a length greater than the length of the rear surface, the length of the side surfaces being less than the length of the front surface and the rear surface, and the front surface having a texture wherein the degree of texturing of the front surface is greater than the degree of texturing of the top surface; and iii) first and second core openings that extend through the block from the top surface to the bottom surface, the first core opening being positioned between the first side surface and the second core opening and the second core opening being positioned between the second side surface and the first core opening;

iv) each core opening being configured so that the area of the core opening at the bottom surface is greater than the area of the core opening at the top surface, and the core opening at the bottom surface has a bottom forwardmost edge and the core opening at the top surface has a top forwardmost edge; and v) the core openings being configured so that when the block is stacked atop other like blocks in a lower course of blocks in set-back relation thereto, at least a portion of the bottom forwardmost edge of each core opening is aligned with at least a portion of the top forwardmost edge of core openings of the blocks in the lower course of blocks.

20. The system of concrete blocks of claim 19, wherein for the concrete corner block, the side face of the first core opening comprises a plurality of walls including a first front wall adjacent the front surface, a first rear wall adjacent the rear surface, a first side wall adjacent the first end surface, and a second side wall adjacent the second core opening, and the side face of the second core opening comprises a plurality of walls including a second front wall adjacent the front surface, a second rear wall adjacent the rear surface, a third side wall adjacent the second end surface and a fourth side wall adjacent the first core opening.

21. The system of concrete blocks of claim 20, wherein the first portion of the side faces includes the first and second front walls.

22. The system of concrete blocks of claim 21, wherein the second portion of the side faces includes the first side wall of the first core opening and the third side wall of the second core opening.

23. The system of concrete blocks of claim 19, wherein for the concrete wall block, each core opening is defined by a side face which diverges from the top surface of the block to the bottom surface of the block, and for each core opening, a first portion of the side face extending from the top forwardmost edge to the bottom forwardmost edge diverges to a greater degree than other portions of the side face.

24. The system of concrete blocks of claim 23, wherein for the concrete wall block the side face of the first core opening comprises a plurality of walls including a first front wall adjacent the front surface, a first rear wall adjacent the rear surface, a first side wall adjacent the first end surface, and a second side wall adjacent the second core opening, and the side face of the second core opening comprises a plurality of walls including a second front wall adjacent the front surface, a second rear wall adjacent the rear surface, a third side wall adjacent the second end surface and a fourth side wall adjacent the first core opening.

25. The system of concrete blocks of claim 24, wherein the first portion of the side faces comprises the first and second front walls.

26. The system of concrete blocks of claim 23, wherein the first and second portions of the core openings of the corner block and the first portion of the wall block are at an angle of about 7 degrees relative to a vertical axis.

27. The system of concrete blocks of claim 19, wherein the locator protrusion comprises a flange projecting downward from the bottom surface of the wall block.

28. The system of blocks of claim 27, wherein the flange has a thickness T, the front surface of the concrete wall block has a length L, and the concrete corner block has a depth equal to $0.5 \times L - T$.

29. The system of concrete blocks of claim 19, wherein for the concrete wall block, the first and second side surfaces intersect the rear surface at an angle of about 1 degree.

30. The system of concrete blocks of claim 19, wherein each core opening is substantially rectangular in top plan view.

* * * * *

UNITED STATES PATENT AND TRADEMARK OFFICE

CERTIFICATE OF CORRECTION

PATENT NO. : 7,037,047 B1
APPLICATION NO. : 11/001725
DATED : May 2, 2006
INVENTOR(S) : Paul R. Tufts et al.

It is certified that error appears in the above-identified patent and that said Letters Patent is hereby corrected as shown below:

Delete Drawings Sheets 1 of 10 and 2 of 10 and substitute therefore the attached Drawings Sheets 1 of 10 and 2 of 10.

Signed and Sealed this

Twenty-fourth Day of April, 2007

JON W. DUDAS
*Director of the United States Patent and Trademark Office*